US008025532B2

(12) United States Patent
Nagata et al.

(10) Patent No.: US 8,025,532 B2
(45) Date of Patent: Sep. 27, 2011

(54) CONNECTOR AND ELECTRONIC EQUIPMENT

(75) Inventors: Takayuki Nagata, Yao (JP); Takao Asano, Isesaki (JP)

(73) Assignee: Hosiden Corporation, Yao-shi (JP)

( * ) Notice: Subject to any disclaimer, the term of this patent is extended or adjusted under 35 U.S.C. 154(b) by 0 days.

(21) Appl. No.: 12/820,474

(22) Filed: Jun. 22, 2010

(65) Prior Publication Data

US 2011/0034079 A1 Feb. 10, 2011

(30) Foreign Application Priority Data

Aug. 7, 2009 (JP) ..... 2009-185113

(51) Int. Cl.
*H01R 13/648* (2006.01)

(52) U.S. Cl. ..... 439/607.4; 439/660

(58) Field of Classification Search ..... 439/660, 439/607.4, 607.35, 607.23
See application file for complete search history.

(56) References Cited

U.S. PATENT DOCUMENTS

| | | | | |
|---|---|---|---|---|
| 6,619,986 | B1 * | 9/2003 | Yeh | 439/607.4 |
| 7,682,200 | B2 * | 3/2010 | Zheng et al. | 439/660 |
| 7,731,535 | B1 * | 6/2010 | Wan et al. | 439/607.4 |
| 7,748,999 | B1 * | 7/2010 | Sun et al. | 439/79 |
| 2005/0118876 | A1 | 6/2005 | Niitsu | |
| 2005/0186843 | A1 | 8/2005 | Tsai | 439/607 |
| 2007/0238330 | A1 | 10/2007 | Xiao et al. | 439/101 |
| 2009/0042421 | A1 | 2/2009 | Zheng et al. | 439/83 |
| 2009/0186528 | A1 * | 7/2009 | Chen | 439/660 |

FOREIGN PATENT DOCUMENTS

| | | | |
|---|---|---|---|
| EP | 1 369 958 | A1 | 12/2003 |
| JP | 2004-537836 | A1 | 12/2004 |
| WO | WO 03/012928 | A1 | 2/2003 |
| WO | WO 03/028169 | A1 | 4/2003 |

OTHER PUBLICATIONS

European Search Report No. 10251139.1 dated Oct. 29, 2010.

* cited by examiner

*Primary Examiner* — Phuong Dinh
(74) *Attorney, Agent, or Firm* — Kratz, Quintos & Hanson, LLP

(57) ABSTRACT

The invention provides a connector including a shield case having a body containing portion; first and second bodies, contained in the body containing portion and combined; first contacts, embedded in the first body and arranged in a row; and second contacts, embedded in the second body and arranged in a different row. The body containing portion includes a top plate, a bottom plate and a pair of side plates. At least one plate of the top plate, the bottom plate and the side plates is smaller in length than the other plates, and a back surface of the one plate functions as an abutting stop surface on which the first body abuts. A back surface of at least one of the other plates is provided with a lock piece, and the first and second bodies are sandwiched between the abutting stop surface and the lock piece.

27 Claims, 13 Drawing Sheets

CONNECTOR AND ELECTRONIC EQUIPMENT

The present application claims priority under 35 U.S.C. §119 of Japanese Patent Application No. 2009-185113 filed on Aug. 7, 2009, the disclosure of which is expressly incorporated by reference herein in its entity.

BACKGROUND OF THE INVENTION

1. Technical Field

The present invention relates to a connector, used as a receptacle or a plug, and an electronic equipment provided with the connector.

2. Background Art

A conventional connector of this type has contacts arranged in two (upper and lower) rows and incorporated into its body by press fitting or insert molding, as disclosed in Patent Literature 1. The press fitting method is unfavorable in fabricating small connectors due to poor workability in incorporating the contacts and low accuracy in positioning the contacts. The insert molding method is more favorable in fabricating small connectors because of better workability in incorporating the contacts, higher accuracy in positioning the contacts, and reduced costs. Nevertheless, insert molding processing has problems in fabricating further downsized connectors, e.g., difficulty in reserving enough thickness of insulating resin (body) to embed the contacts. Particularly, for a small-sized connector having tail portions of contacts arranged in two rows at the same height (i.e., connector suitable for mounting by a surface mount technology (SMT) method), it is very difficult to insert-mold the contacts in two rows in a single body.

This problem may be solved in another conventional connector as disclosed in Patent Literature 2. Particularly, the body of the connector is divided into first and second bodies, and a first row of contacts are embedded in the first body and a second row of contacts are embedded in the second body by insert molding, and then, the first and second bodies are combined. By insert-molding each row of contacts in each of the two bodies, it is possible to reserve enough thickness of the body.

Citation List

Patent Literature 1: WO2003/028169 (also published as US2005118876A)

Patent Literature 2: JP 2004-537836 A (also published as WO03/028169)

SUMMARY OF INVENTION

Technical Problem

However, there is another problem in the connector having the first and second bodies—it is difficult to fix the combined first and second bodies in position inside the shield case. The first and second bodies are apt to be displaced inside the shield case, resulting inferior accuracy in positioning the first and second contacts.

The present invention is devised in light of the above-described situation. The invention provides a connector and electronic equipment having first and second bodies and first and second contacts that can be fixed accurately in position inside a shield case.

Solution to Problems

A connector of the present invention includes a shield case having a body containing portion; first and second bodies, contained in the body containing portion of the shield case and combined in a fore-and-aft direction; a plurality of first contacts, embedded in the first body and arranged in a row in a width direction of the first body; and a plurality of second contacts, embedded in the second body and arranged in a width direction of the second body in a different row from the row of the first contacts. The body containing portion includes a top plate, a bottom plate and a pair of side plates. At least one plate of the top plate, the bottom plate and the side plates is smaller in length than the other plates, and a back surface of the one plate functions as an abutting stop surface on which the first body abuts. A back surface of at least one of the other plates is provided with a lock piece, and the first and second bodies are sandwiched between the abutting stop surface and the lock piece.

According to this aspect of the invention, as the first and second contacts are embedded by insert molding in the first and second bodies, respectively, even if the connector is downsized, the first and second bodies can have enough thickness to embed and hold the first and second contacts therein. In addition, the first and second contacts are less prone to distortion compared to a case where the contacts are press-fitted into the bodies. The first and second contacts are also advantageous in reducing the pitch variation therebetween due to distortion. Consequently, the first and second contacts can be arranged in the first and second bodies with high accuracy. Further, the combined first and second bodies are sandwiched between the abutting stop surface and the lock piece. It is thus easy to fix the first and second bodies in position inside the body containing portion of the shield case, preventing misalignment of the first and second body inside the shield case and improving accuracy of the positioning of the first and second contacts. Consequently, the first and second contacts can be positioned with high accuracy and stability. Moreover, it is advantageously easy to incorporate the combined first and second bodies into the shield case, simply by bringing the first body into abutment with the abutting stop surface and the lock piece into abutment with the second body. Moreover, in the case where distal end portions of the first and second contacts are bent in directions close to one another, if the first and second contacts were buried in one body, the distance between the distal end portions of the first and second contacts would be too small to ensure pressure-resistance. In contrast, the connector of the invention has the first contacts buried in the first body and the second contacts buried in the second body, so that it is possible to allot enough distance between the distal end portions of the first and second contacts to ensure the pressure-resistance.

The first body may have a fitting protrusion on a surface thereof facing the second body and the second body has a fitting recess in a surface thereof facing the first body, or alternatively the first body has a fitting recess in a surface thereof facing the second body and the second body has a fitting protrusion on a surface thereof facing the first body. The fitting protrusion may fit into the fitting recess when the first and second bodies are combined. In this aspect of the invention, simply by fitting the fitting protrusion into the fitting recess, the first and second bodies can be fixed together in position, placing the first and second contacts into position securely in two rows. Consequently, the first and second contacts are advantageously stable in positioning accuracy.

A distance between the bottom plate and the top plate may be substantially the same as a height dimension of the first body. A lower surface of the first body may abut the bottom plate, and an upper surface of the first body may abut the top plate. In this aspect of the invention, with the first body contained in the body containing portion, the lower surface of the first body abuts the bottom plate and the upper surface of the first body abuts the top plate. The positioning accuracy of the first body and the second body combined with the first body is further improved. Accordingly, the positioning accuracy of the first and second contacts is further improved.

If the connector is a receptacle connector, the back surface of the bottom plate may serves as the abutting stop surface. The first body may includes: a main body of a generally rectangular shape in cross-sectional view; a projected portion, projected from a front surface of the main body; and a protruded portion, provided on a lower surface of the main body and abutting the abutting stop surface. The projected portion may have first and second surfaces in a thickness direction thereof, the first and second surfaces being provided with first long grooves and second long grooves, respectively, extending in the fore-and-aft direction. The main body may have holes communicating with the second long grooves. Each of the second contacts may include: a second buried portion buried in the second body; a second contact portion continued from a lengthwise end of the second buried portion and received in one of the holes and one of the second long grooves; and a second tail portion continued from the other lengthwise end of the second buried portion. Each of the first contacts may include: a first buried portion buried in the main body of the first body; a first contact portion continued from a lengthwise end of the first buried portion and received in one of the first long grooves of the projected portion; and a first tail portion continued from the other lengthwise end of the first buried portion and disposed near the protruded portion.

In this aspect of the invention, the protruded portion located near the first tail portions abuts the abutting stop surface and is fixed, board-mounting portions of the contacts, i.e. the first and second tail portions, can be mounted on the circuit board advantageously with accurate pitches and coplanarity. Additionally, the second contact portions of the second contacts can be fixed in position simply by inserting the second contact portions of the second contacts into the holes and the second grooves of the first body when combining the first body with the second body.

If the connector is a receptacle connector, the shield case may have the body containing portion having a substantially O shape in front-plane view, a pair of folded-back portions, extending from front surfaces of the side plates of the body containing portion and folded back backward, or alternatively extending from the back surfaces of the side plates of the body containing portion and folded back forward; a pair of side walls, extending from the folded-back portions along the side plates of the body containing portion; a pair of first locking pieces, extending downward from the side walls; and a linking portion adapted to link between the side walls.

In the above receptacle connector with the locking pieces provided on the side walls extending along the side plates of the body containing portion, it obviates the needs to cut out the bottom plate of the body containing portion to form the locking pieces, and there will be no holes formed by cutting out the bottom plate. This aspect of the invention is thus advantageous in preventing the entry of solder and flux into the body containing portion when the base is set on a circuit board and the locking pieces are soldered to the circuit board. In addition, the side walls linked by the linking portion are resistant to inclination and/or skew if the plug is twisted inside the body containing portion. Consequently, the connector can advantageously reduce load applied on the folded-back portions and on the solder-connected portions between the locking pieces and the circuit board due to the inclination and/or skew of the side walls.

Alternatively, the shield case may have a base of a generally U-shape in front view having widthwise end portions, the end portions each having a front surface and a back surface; a pair of folded-back portions, provided on the front surfaces of the end portions of the base and folded back backward, or alternatively provided on the back surfaces of the end portions of the base and folded back forward; a pair of side walls, extending from the folded-back portions along the end portions of the base; a pair of first locking pieces, extending downward from the side walls; and a linking portion adapted to link between the side walls. The body containing portion may be defined by the base, the side walls and the linking portion. The base may serve as the bottom plate, the side walls may serve as the side plates, and the linking portion may serve as the top plate. The base may be smaller in length than the linking portion, and a back surface of the base may serve as the abutting stop surface. The back surfaces of the side walls or the back surface of the linking portion of the shield case may be provided with a lock piece, and the first and second bodies may be sandwiched between the abutting stop surface and the lock piece.

In the above receptacle connector with the locking pieces provided on the side walls extending along the end portions of the base, it obviates the needs to cut out the bottom plate of the body containing portion to form the locking pieces, and there will be no holes formed by cutting out the bottom plate. This aspect of the invention is thus advantageous in preventing the entry of solder and flux into the body containing portion when the body containing portion is set on a circuit board and the locking pieces are soldered to the circuit board. In addition, the side walls linked by the linking portion are resistant to inclination and/or skew if the plug is twisted inside the body containing portion. Consequently, the connector can advantageously reduce load applied on the folded-back portions and on the solder-connected portions between the locking pieces and the circuit board due to the inclination and/or skew of the side walls.

Still alternatively, the shield case may have a base of a generally U-shape in front view having widthwise end portions, the end portions each having a front surface and a back surface; a pair of folded-back portions, provided on the front surface of the end portions of the base and folded back backward, or alternatively provided on the back surfaces of the end portions of the base and folded back forward; a pair of side walls, extending from the folded-back portions along the end portions of the base; a pair of first locking pieces, extending downward from the side walls; and a linking portion adapted to link between the side walls. The body containing portion may be defined by the base, the side walls and the linking portion. The base may serve as the bottom plate, the side walls may serve as the side plates, and the linking portion may serve as the top plate. The linking portion may be smaller in length than the base, and a back surface of the linking portion serves as the abutting stop surface. The back surfaces of the side walls or the back surface of the base of the shield case may be provided with a lock piece, and the first and second bodies may be sandwiched between the abutting stop surface and the lock piece.

In the above receptacle connector with the locking pieces provided on the side walls extending along the end portions of the base, it obviates the needs to cut out the base plate of the body containing portion to form the locking pieces, and there will be no holes formed by cutting out the base plate. This aspect of the invention is thus advantageous in preventing the entry of solder and flux into the body containing portion when the body containing portion is set on a circuit board and the locking pieces are soldered to the circuit board. In addition, the side walls linked by the linking portion are resistant to inclination and/or skew if the plug is twisted inside the body containing portion. Consequently, the connector can advantageously reduce load applied on the folded-back portions and on the solder-connected portions between the locking pieces and the circuit board due to the inclination and/or skew of the side walls.

The first locking pieces may be provided on lower ends of the side walls. The linking portion links between upper ends of the side walls.

If the first body has an abutting surface, on which a distal end surface of a plug inserted in the body containing portion may be abuttable, the first locking pieces may be disposed forward of the abutting surface. When a plug is twisted inside the body containing portion, with a cable connected to the plug acting as an application point of effort, loads will be applied to the shield case, with the distal end of the plug acting as a fulcrum. To address this possibility, the first locking pieces in this aspect of the invention are disposed forward of the abutting surface of the body on which the distal end surface of the plug is to abut (i.e., on the point of effort side with respect to the fulcrum), loads applied on the first locking pieces can be reduced as compared with a case where the locking pieces are disposed backward of the abutting surface (i.e., backward of the fulcrum). Consequently, the invention is advantageous in preventing detachment of the shield case or a connector having the shield case from the circuit board, and also in preventing deformation or damage of the shield case and the connector.

The shield case may further include a pair of second locking pieces extending downward from the lower end surfaces of the side walls. The shield case should thus be more securely fixed to the circuit board by soldering the first and second locking pieces to the circuit board.

The side walls and the linking portion may be larger in length than the base. The side walls may have non-facing regions at lower ends thereof, the non-facing regions not facing the base. The shield case may further include a pair of holders provided in the respective non-facing regions. A distance between the holders and the linking portion may be substantially the same as a height dimension of the body. A lower surface of the first body may abut the holders, and an upper surface of the first body may abut the linking portion. In this aspect of the invention, with the first body contained in the body containing portion, the lower surface of the first body abuts the holder and the upper surface of the first body abuts the linking portion to fix the first body, further improving positioning accuracy of the combined first and second bodies. Accordingly, the positioning accuracy of the first and second contacts is also further improved.

The base or the linking portion may have a first piece provided with a recess and a second piece provided with a protrusion. The first and second pieces may be caulked in a state where the protrusion is fitted into the recess.

The first and second tail portions may be arranged in two rows in the fore-and-aft direction. The first and second tail portions in two rows are connectable by soldering to first and second electrodes disposed in two rows in the fore-and-aft direction in the circuit board. Moreover, the first and second tail portions may be hung downward. Such first and second tail portions are connectable by soldering into first and second through-holes formed in two rows in the fore-and-aft direction in the circuit board.

Alternatively, the first and second tail portions may be aligned in a row if the first and second contacts are arranged in a zigzag manner. The first and second tail portions in a row are connectable to the first and second electrodes disposed in a row in the circuit board. Moreover, the first and second tail portions may be hung downward. Such first and second tail portions are connectable by soldering them into the first and second through-holes formed in a row in the circuit board.

An electronic equipment of the present invention may be provided with the receptacle connector as described above as its external interface.

BRIEF DESCRIPTION OF DRAWINGS

FIG. 5A is a view seen obliquely from the bottom right back side, and FIG. 5B is a view seen obliquely from the top right back side.

FIG. 10A exemplifies a case where a top plate of the shield case is smaller in length than a bottom plate and side plates. FIG. 10B exemplifies a case where the side plates are smaller in length than the top plate and the bottom plate.

FIG. 13A is a bottom view showing a case where the first and second tail portions are arranged in a row, and FIG. 13B is a cross-sectional view showing a case where the first and second tail portions are hung downward and connected into first and second through-holes of the board.

DESCRIPTION OF EMBODIMENTS

Hereinafter, a receptacle connector according to an embodiment of the present invention is described with reference to FIGS. 1A to 9. The receptacle connector shown in FIGS. 1A to 3B is compliant with the HDMI (High-Definition Multimedia Interface) standard, to be mounted on a circuit board 10 of an electronic equipment, such as a television receiver, and used as an external interface of the electronic equipment. The receptacle connector includes first and second bodies 100*a*, 100*b*, a plurality of first and second contacts 200*a*, 200*b*, and a shield case 300. The respective elements of the connector will be described in detail below.

Figure 2C:
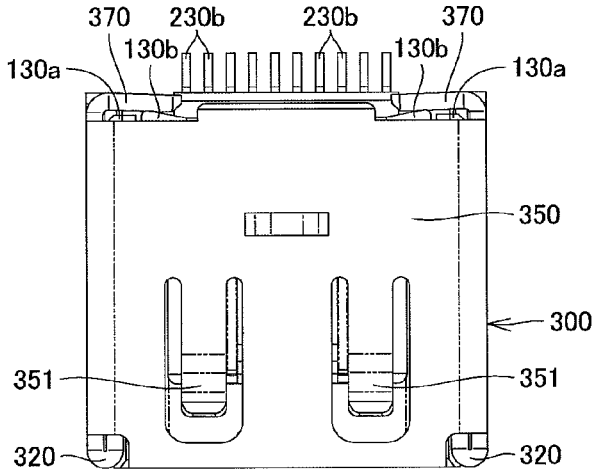
FIGS. 2A to 2D are schematic views of the connector, FIG. 2A being a front view, FIG. 2B being a back view, FIG. 2C being a plan view, and FIG. 2D being a bottom view.
Figure 2A:
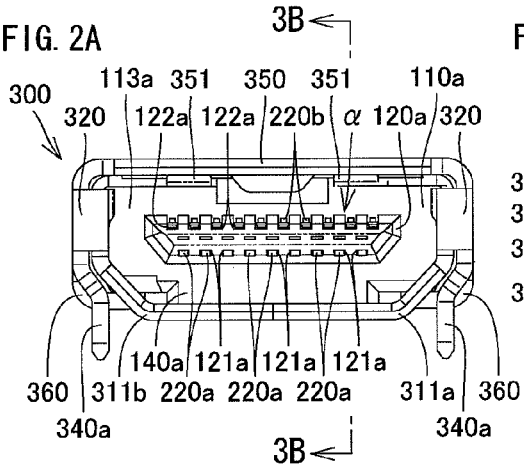
Figure 2B:
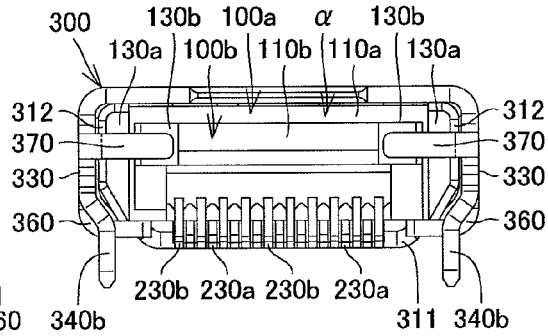
Figure 2D:
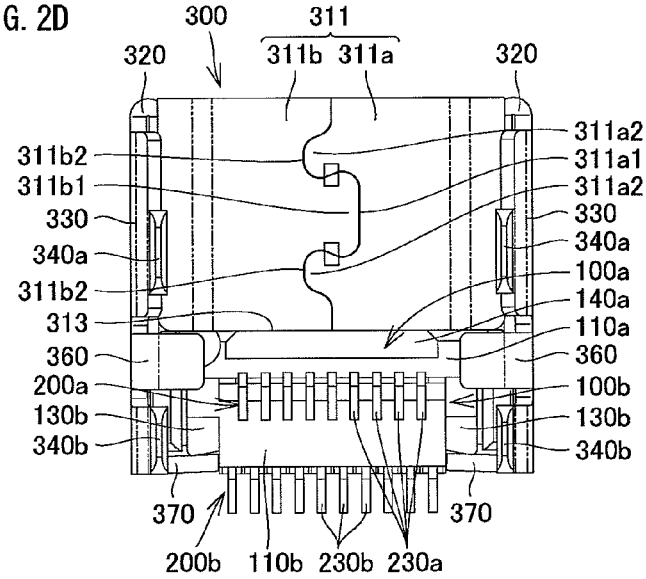
Figure 3A:
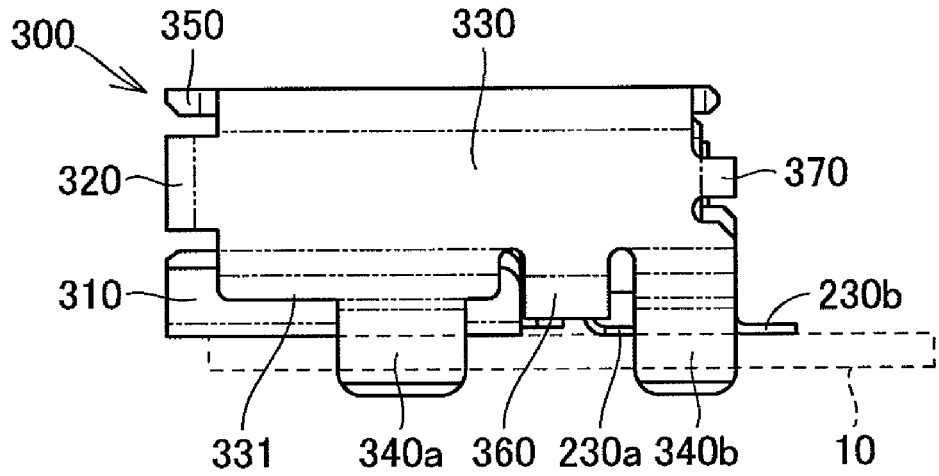
FIGS. 3A and 3B are schematic views of the connector mounted on a circuit board, FIG. 3A being a side view, and FIG. 3B being a cross-sectional view taken along line 3-3 in FIG. 2A.
Figure 3B:
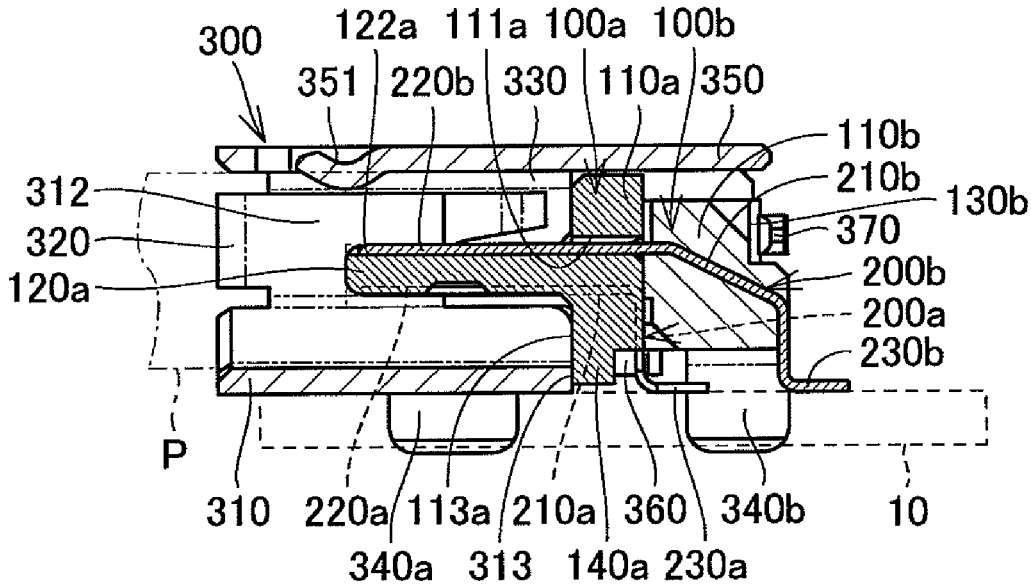
Figure 4:
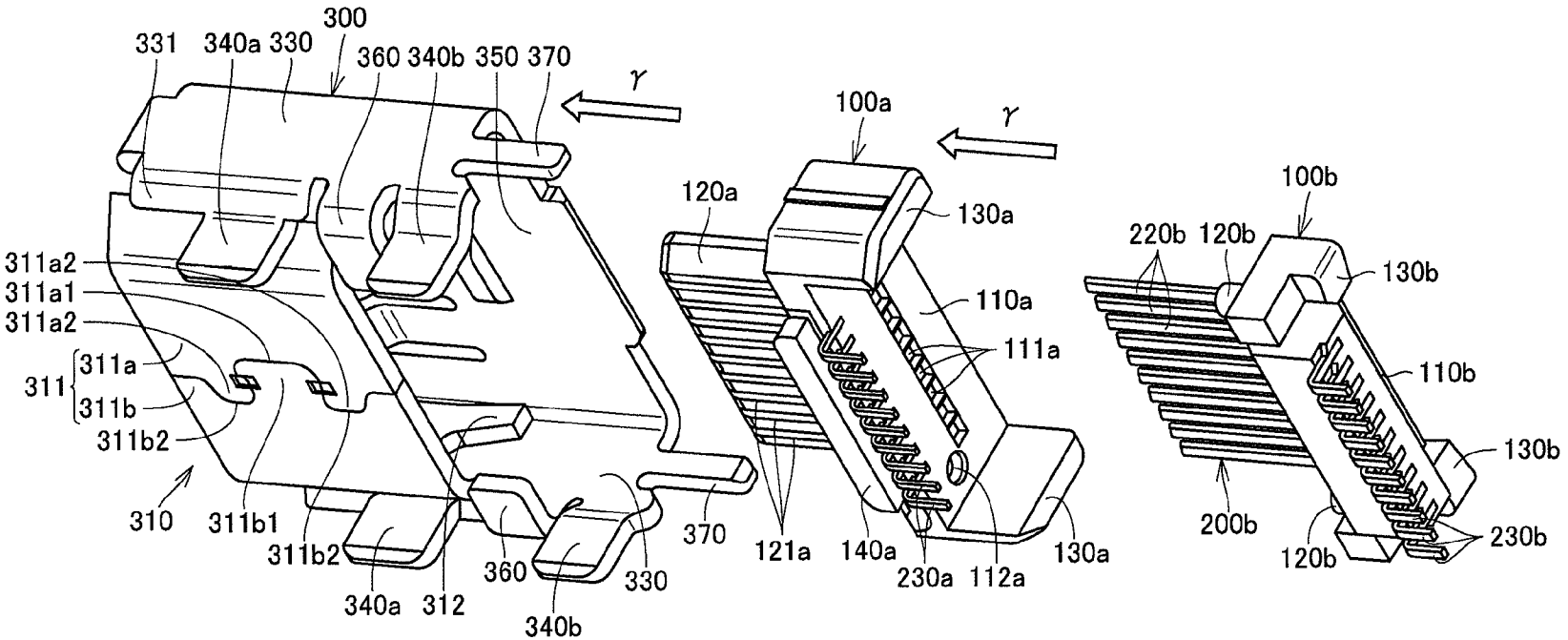
FIG. 4 is a schematic exploded perspective view of the connector.

The first body 100*a* is a molded article of insulating resin, as shown in FIGS. 1B to 6B. The first body 100*a* has a main body 110*a*, a projected portion 120*a*, a pair of walls 130*a*, and an elongated protrusion 140*a* (protruded portion). The main body 110*a* is a plate-like body having a generally rectangular shape in cross-sectional view. A plurality of generally rectangular holes 111*a* are formed in the middle of the main body 110*a*, spaced from one another and aligned in the width direction of the main body 110*a*, as shown in FIGS. 3B, 4 and 6A. The holes 11*a* penetrate the main body 110*a* in a fore-and-aft direction γ. Below the holes 111*a* in the main body 110*a*, the first contacts 200*a* are disposed in a row, spaced from one another in the width direction. The first contacts 200*a* are arranged with the phase shifted from the holes 111*a*, as shown in FIG. 6A. In other words, each of the first contacts 200*a* is arranged between respective two adjacent holes 111*a* in plan position. Moreover, circular fitting recesses 112*a* are provided in a back surface (surface facing the second body) of the main body 110*a*, one at either side of the holes 111*a*. The walls 130*a* are generally rectangular and extend backward from opposite widthwise ends of the main body 110*a*.

Figure 5A:
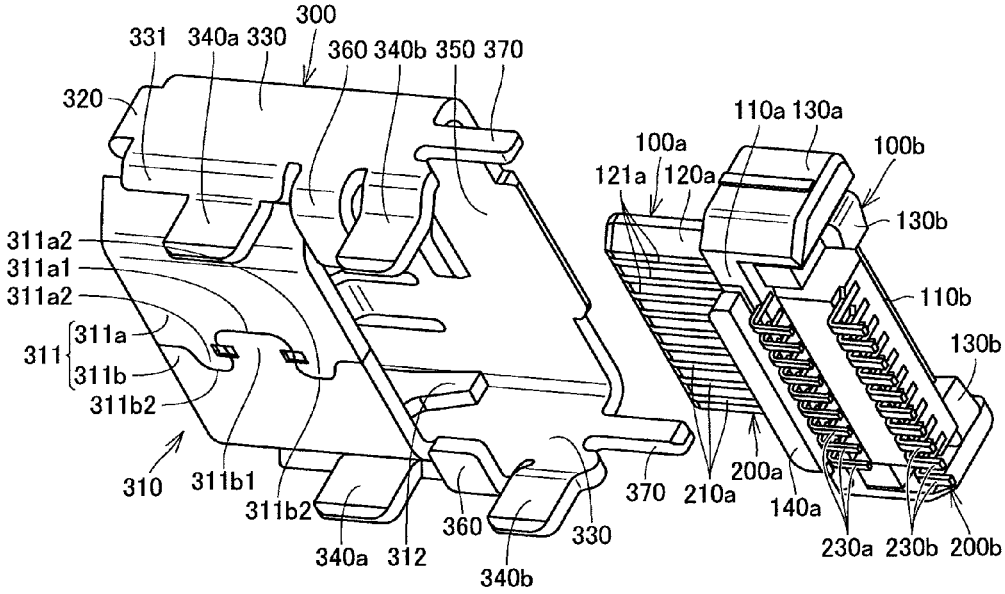
FIGS. 5A and 5B are schematic perspective views of the connector, illustrating a state where its first and second bodies are combined but yet to be contained in a shield case.
Figure 6A:
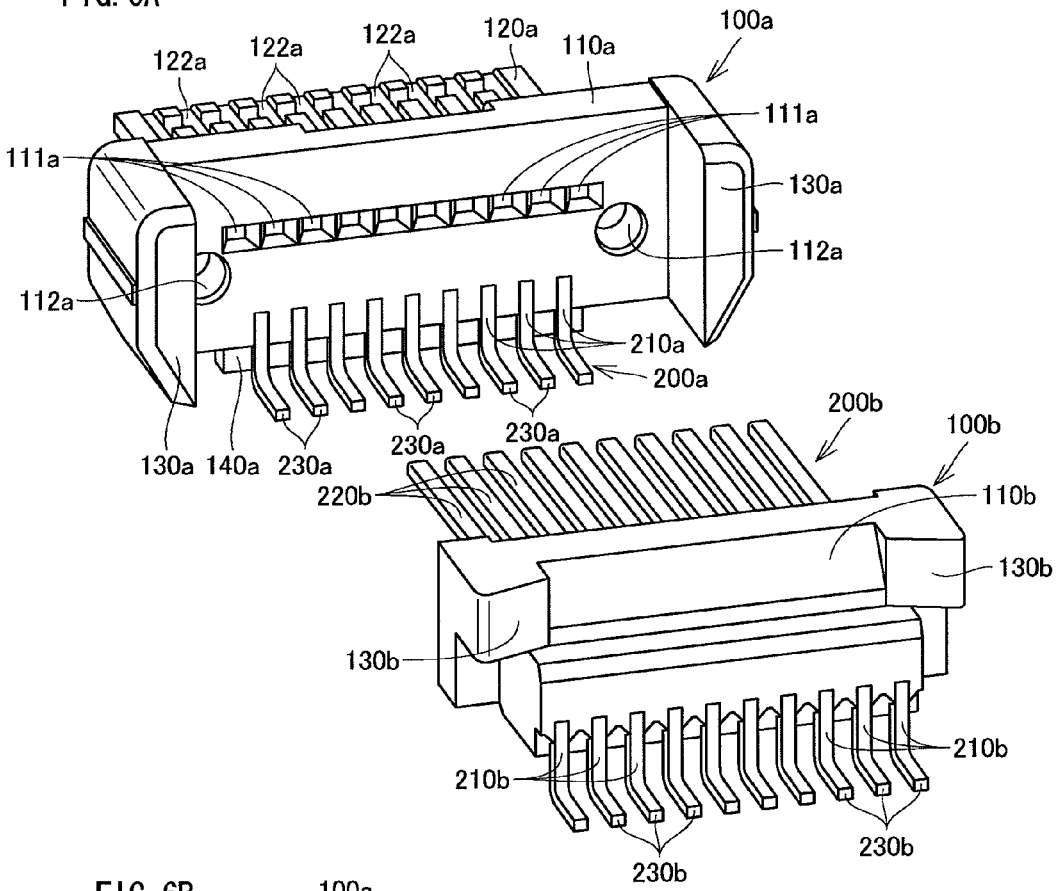
FIGS. 6A and 6B are schematic views of the first and second bodies of the connector, illustrating a state before they are combined, FIG. 6A being a view seen obliquely from the upper right back side, and FIG. 6B being a plan view.
Figure 6B:
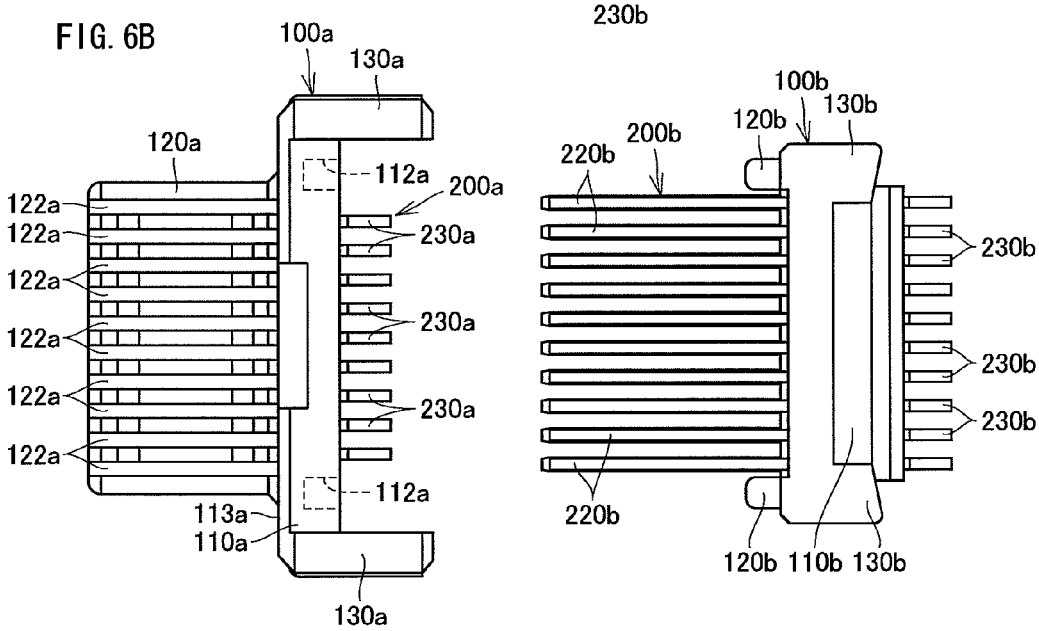

A front surface 113*a* of the main body 110*a* forms an abutting surface on which a mating plug P is abuttable, as shown in FIG. 3B. The projected portion 120*a* is provided below the holes 111*a* on the front surface 113*a* of the main body 110*a*. The projected portion 120*a* is a plate-like body extending toward the front of the connector. The lower surface of the projected portion 120*a* (first surface in a thickness direction) is provided with a plurality of first long grooves 121*a*, as shown in FIGS. 4 and 5A. The upper surface (second surface in the thickness direction) of the projected portion 120*a* is provided with a plurality of second long grooves 122*a*, as shown in FIGS. 6A and 6B. The first and second long grooves 121*a*, 122*a* are arranged in a zigzag manner in front view as shown in FIG. 2A. The first long grooves 121*a* corresponds in pitch distance to the first contacts 200*a*. The first long grooves 121*a* receive first contact portions 220*a* (to be described) of the first contacts 200*a*. The second long grooves 122*a* correspond in pitch distance to the holes 111*a* and communicate with the holes 111*a*, as shown in FIG. 3B. The lower surface of the main body 110*a* is provided with the elongated protrusion 140*a* of a generally rectangular shape in cross-sectional view, as shown in FIGS. 2D, 3B, 4 and 5A. The elongated protrusion 140*a* is located in a front-side vicinity of first tail portions 230*a* (to be described) of the first contacts 200*a*.

The first contacts 200*a* are elongated metal plates having electrical conductivity. As shown in FIG. 3B, the first contacts 200*a* each have a first buried portion 210*a* of a generally downward L-shape, a first contact portion 220*a* in flat plate form continuing from the distal end (one end in the length direction) of the first buried portion 210*a*, and a first tail portion 230*a* in flat plate form continuing from the rear end (the other end in the length direction) of the first buried portion 210*a*. The first buried portion 210*a* except its rear end is buried in the main body 110*a*. The rear end of the first buried portion 210*a* sticks out downward from the main body 110*a*. The first contact portion 220*a* sticks out from the main body 110*a* and is inserted into one of the first long grooves 121*a* of the projected portion 120*a*. The first tail portion 230*a* is bent at a substantially right angle with respect to the rear end of the first buried portion 210*a*. The first tail portion 230*a* is connected by soldering with one of first electrodes 11*a* of the circuit board 10 shown in FIG. 9.

The second body 100*b* is a molded article of insulating resin as shown in FIGS. 1B to 6B. The second body 100*b* has a main body 110*b*, a pair of fitting protrusions 120*b*, and a pair of hills 130*b*. The main body 110*b*, as shown in FIGS. 2B, 5A and 5B, has a generally L-shape in cross-sectional view and has a width slightly smaller than a distance between the pair of walls 130*a* of the first body 100*a*. That is, the main body 110*b* is adapted to be held between the walls 130*a*. As shown in FIG. 6B, the pair of fitting protrusions 120*b* is provided at opposite widthwise ends of a front surface (surface facing the first body) of the main body 110*b*. These fitting projections 120*b* are columnar projections adapted to be fitted into the fitting recesses 112*a* of the first body 100*a*. By fitting the fitting projections 120*b* into the fitting recesses 112*a*, the first and second bodies 100*a*, 100*b* are securely combined in the fore-and-aft direction γ of the connector. The main body 110*b* holds the second contacts 200*b* that are arranged in a row and in spaced relation to one another in the width direction. The second contacts 200*b* are arranged in such a manner that their second contact portions 220*b* (to be described) correspond in position to the holes 111*a* of the first body 100*a*. That is, in the state where the first and second bodies 100*a*, 100*b* are combined in the fore-and-aft direction γ, the second contact portions 220*b* of the second contacts 200*b* are received in the holes 111*a* and the second long grooves 122*a* of the first body 100*a*, so that the first and second contact portions 220*a*, 220*b* of the first and second contacts 200*a*, 200*b* are arranged at different heights in two rows to form a zigzag arrangement. The pair of hills 130*b* is provided at opposite widthwise ends of a back surface of the main body 110*b*. As shown in FIG. 2D, distal ends of the hills 130*b* project backward further than the walls 130*a* in the state where the first and second bodies 100*a*, 100*b* are combined in the fore-and-aft direction γ of the connector.

The second contacts 200*b* are elongated metal plates having electrical conductivity. As shown in FIG. 3B, the second contacts 200*b* each have a second buried portion 210*b*, a second contact portion 220*b* continuing from the distal end (one end in a length direction) of the second buried portion 210*b*, and a second tail portion 230*b* continuing from the rear end (the other end in the length direction) of the second buried portion 210*b*. The second buried portion 210*b* has an intermediate portion inclined obliquely, and a distal end portion bent relative to the intermediate portion, and a back end portion bent relative to the intermediate portion and hanging downward. The distal end portion and the intermediate portion of the second buried portion 210*b* are buried in the main body 110*b*. The rear end portion of the second buried portion 210*b* sticks out downward from the main body 110*b*. The second contact portion 220*b* is a flat plate longer than the first contact portion 220*a* and sticks out from the front surface of the main body 110*b*. The second contact portion 220*b* is received in one of the holes 111*a* and the communicating one of the second long grooves 122*a* of the first body 100*a*, as described above. The second tail portion 230*b* is a flat plate bent at a substantially right angle with respect to the rear end portion of the second buried portion 210*b*. The second tail portion 230*b* is connected by soldering with one of second electrodes 11*b* of the circuit board 10 shown in FIG. 9. A lower surface of the second tail portion 230*b* is set at the same height position as that of a lower surface of the first tail portion 230*a* in the state where the first and second bodies 100*a*, 100*b* are combined. That is, with the first and second bodies 100*a*, 100*b* combined, the first tail portions 230*a* and the second tail portions 230*b* are arranged in two rows—as front and back rows, respectively—at the same height position.

The shield case 300 is fabricated by press-molding a metal plate having electrical conductivity, as shown in FIGS. 1A to 8B. The shield case 300 has a base 310 of generally U-shape in front view, a pair of folded-back portions 320, a pair of side walls 330, pairs of first and second locking pieces 340*a*, 340*b*, a linking plate 350 (linking portion), a pair of holders 360, and a pair of lock pieces 370.

Figure 8A:
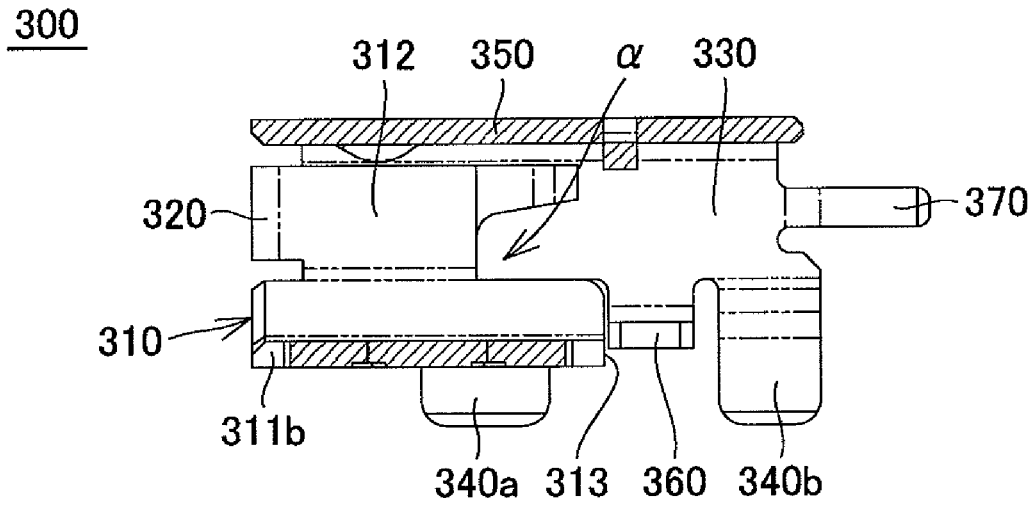
FIGS. 8A and 8B are schematic cross-sectional views of the shield case, FIG. 8A being a cross-sectional view taken along line 8A-8A in FIG. 7A, and FIG. 8B being a cross-sectional view taken along line 8B-8B in FIG. 7A.
Figure 8B:
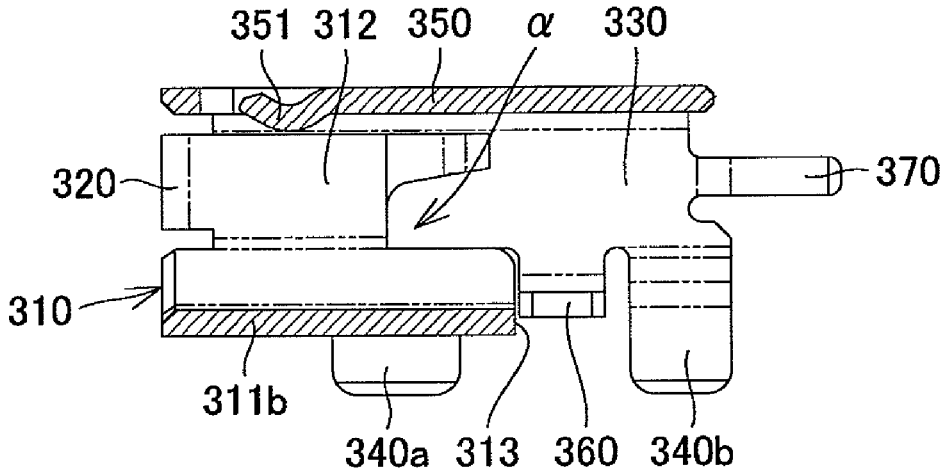
Figure 9:
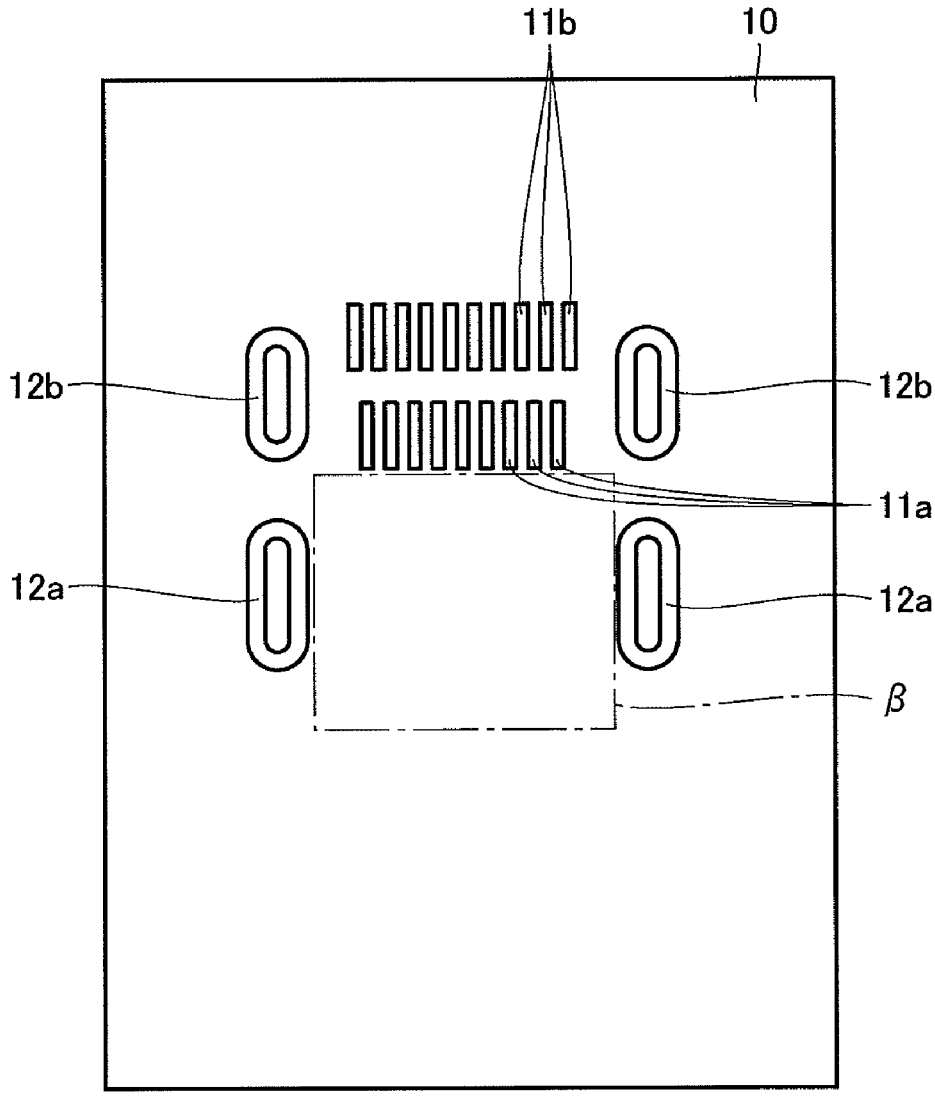
FIG. 9 is a schematic plan view of the circuit board for mounting the connector.

The base 310 has a base body 311, which is a plate of generally U-shape in front view, and a pair of extended portions 312 (widthwise end portions). The base body 311 is divided in the width direction into two pieces, one of which a first piece 311*a* and the other is a second piece 311*b*. The first piece 311*a* has a first recess 311*a*1 and a pair of first protrusions 311*a*2 on either side of the first recess. The second piece 311*b* has a second protrusion 311*b*1 and a pair of second recesses 311*b*2 on either side of the second protrusion. The second protrusion 311*b*1 is fitted in the first recess 311*a*1, and the first protrusions 311*a*2 are fitted in the second recesses 311*b*2. The first and second pieces 311*a*, 311*b* are then caulked and joined together. The extended portions 312 are plates of generally downward L-shape, extending from the outer ends of the base body 311, as shown in FIGS. 8A and 8B. The front surfaces of the extended portions 312 are continued to the folded-back portions 320.

Figure 7C:
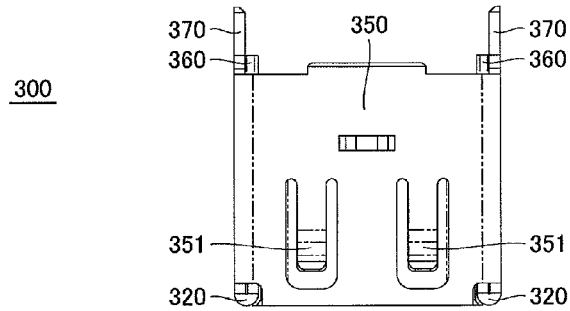
FIGS. 7A to 7E are schematic views showing the shield case of the connector, FIG. 7A being a front view, FIG. 7B being a back view, FIG. 7C being a plane view, FIG. 7D being a bottom view, and FIG. 7E being a side view.
Figure 7E:
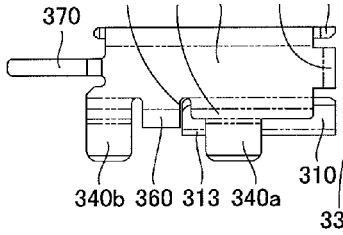
Figure 7A:
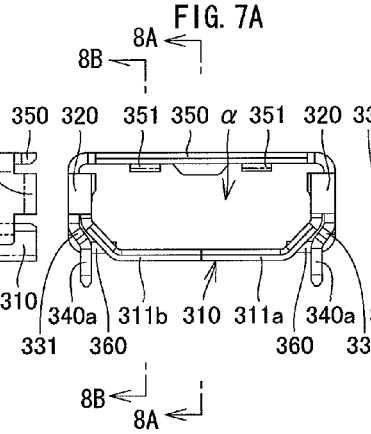
Figure 7B:
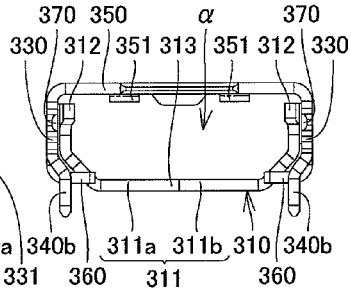
Figure 7D:
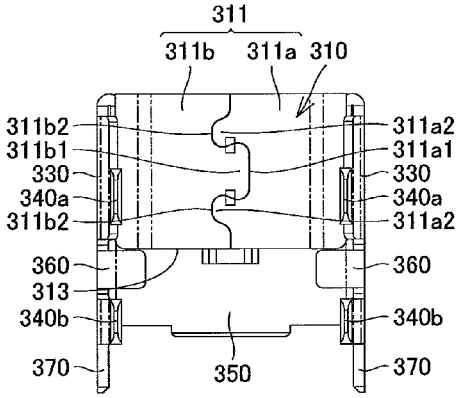

The folded-back portions 320 are plates of generally U-shape in plan view that are folded back backward. The rear ends of the folded-back portions 320 are continued to the side walls 330. The side walls 330 are generally rectangular plates extending backward along the extended portions 312, and they are longer than the base 310. As shown in FIGS. 7A and 7E, a lower end portion of each of the side walls 330 is divided by an incision 332 into a portion facing the base body 311 (referred to hereinafter as an facing portion 331) and a portion not facing the base body 311 (referred to hereinafter as an non-facing portion). The facing portions 331 are bent so as to incline toward the base body 311. Upper ends of the side walls 330 are linked by the linking plate 350. The linking plate 350 is a generally rectangular plate having a substantially same length dimension as those of the side walls 330. That is, the length dimension of the linking plate 350 is larger than that of the base 310. The base 310, the side walls 330 and the linking plate 350 define a body containing space α (body containing portion). The body containing space α receives and contains the first and second bodies 100*a*, 100*b* combined in the fore-and-aft direction γ as described above, from the back side of the shield case 300. It should be noted that the base 310 serves as a bottom plate defining the body containing space α, and the side walls 330 serve as side plates defining the body containing space α, and the linking portion 350 serves as a top plate defining the body containing space α.

As shown in FIG. 3B, back surfaces of the first and second pieces 311*a*, 311*b* of the base 310 function as an abutting stop surface 313. When the first body 100*a* is contained in the body containing space α, the front surface of the elongated protrusion 140*a* of the first body 100*a* abuts the abutting stop surface 313 abuts and stops. The back surfaces of the side walls. 330 are provided with the lock pieces 370. The lock pieces 370 are bent at a substantially right angle with respect to the side walls 330 to abut against the pair of hills 130*b* of the second body 100*b* contained in the body containing space α. That is, the first and second bodies 100*a*, 100*b* are sandwiched and fixed between the lock pieces 370 and the abutting stop surface 313. FIGS. 4, 5A, 5B, 7A to 7E, 8A, and 8B illustrate the lock pieces 370 in a pre-bend state.

Figure 1A:
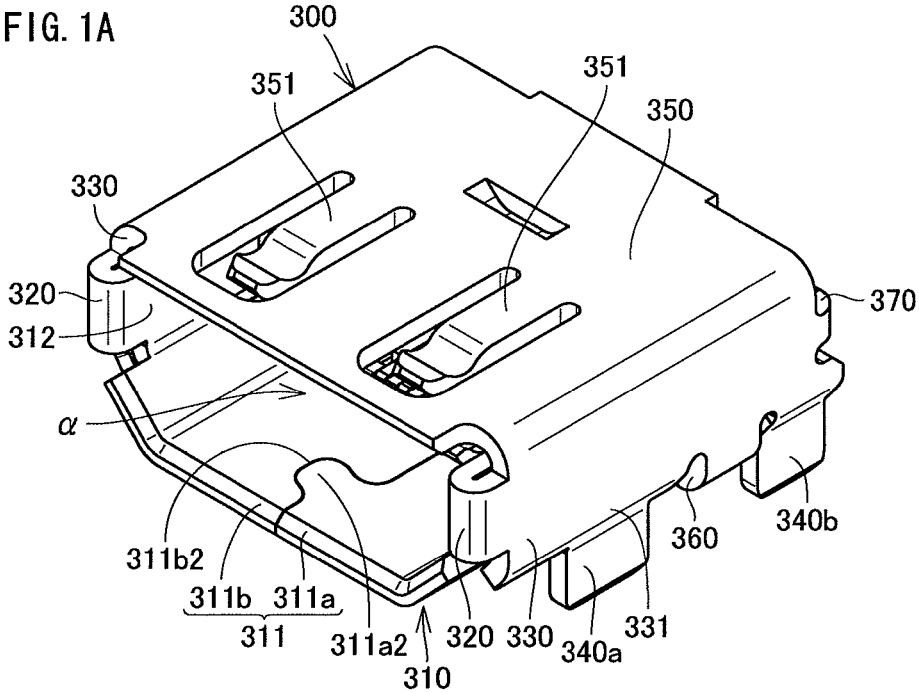
FIGS. 1A and 1B are schematic perspective views of a receptacle connector according to an embodiment of the present invention, FIG. 1A being a view seen obliquely from upper right, and FIG. 1B being a view seen obliquely from lower right.
Figure 5B:
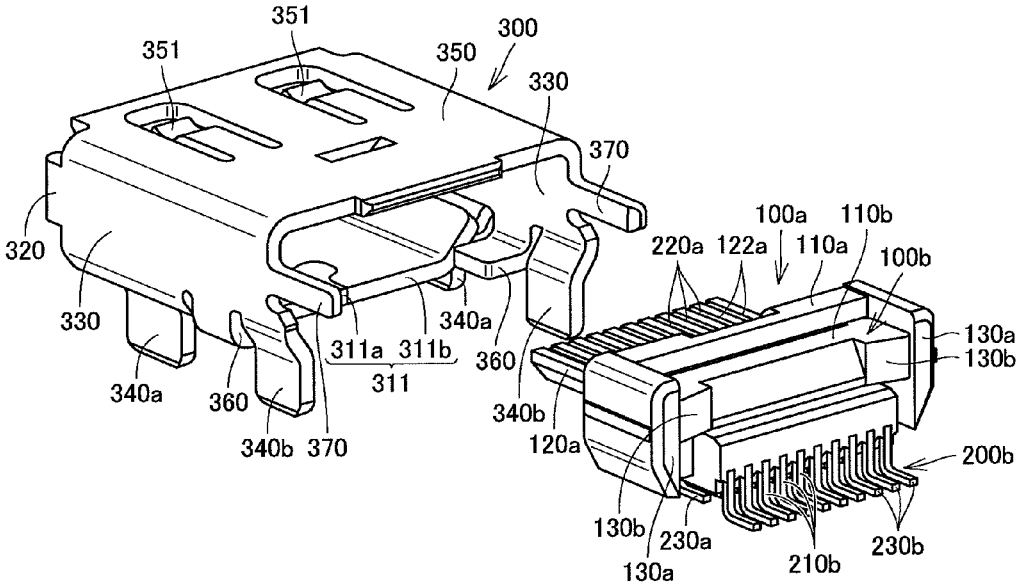

As shown in FIG. 3B, in the body containing space α, space defined by the base 310, the linking plate 350, and the front surface 113*a* of the main body 110*a* of the first body 100*a* functions as a plug receiving hole to receive the plug P. As shown in FIGS. 1A, 2C and 5B, the linking plate 350 is provided with a pair of lock arms 351 formed by cutting out portions of the linking plate 350. Distal end portions of the lock arms 351 are bent downward in a generally U-shape, and apexes of the distal end portions are located inside the body containing space α. As such, when the plug P is inserted into the body containing space α, the apexes of the lock arms 351 come into elastic contact with the plug P to hold the plug P.

In the side walls 330, lower ends of the facing portions 331 facing the base 310 are provided with the first locking pieces 340*a* extending downward (in the direction perpendicular to the length direction and the width direction of the side walls 330), while lower ends of the non-facing portions are provided with the holders 360 and the second locking pieces 340*b*, both extending downward. The first and second locking pieces 340*a*, 340*b* are to be inserted for soldering into first and second locking holes 12*a*, 12*b* of the circuit board 10 shown in FIG. 9. The first and second locking holes 12*a*, 12*b* are through-hole electrodes connected to a ground layer of the circuit board 10. As shown in FIG. 2B, the first locking pieces 340*a* are arranged forward of the front surface 113*a* of the main body 110*a* of the first body 100*a* contained in the body containing space α. This arrangement is designed assuming a case where a user twists the plug P (i.e. turns it in a circumferential direction) received in the plug receiving hole of the body containing space α. In this case, a cable (not shown) connected to the plug P acts as an application point of effort, a distal end of the plug P acts as a fulcrum, and loads are applied to the shield case 300. However, the first locking pieces 340*a* are disposed forward of the front surface 113*a* (abutting surface) of the main body 110*a* on which the distal end of the plug abuts (i.e., on the point of effort side with respect to the fulcrum), loads applied on the first locking pieces 340*a* should be reduced as compared with a case where the first locking pieces 340*a* are disposed backward of the abutting surface (i.e., backward of the fulcrum). The first locking pieces 340*a* thus arranged can prevent detachment of the connector from the circuit board 10 and also prevent deformation or damage of the connector.

Figure 1B:
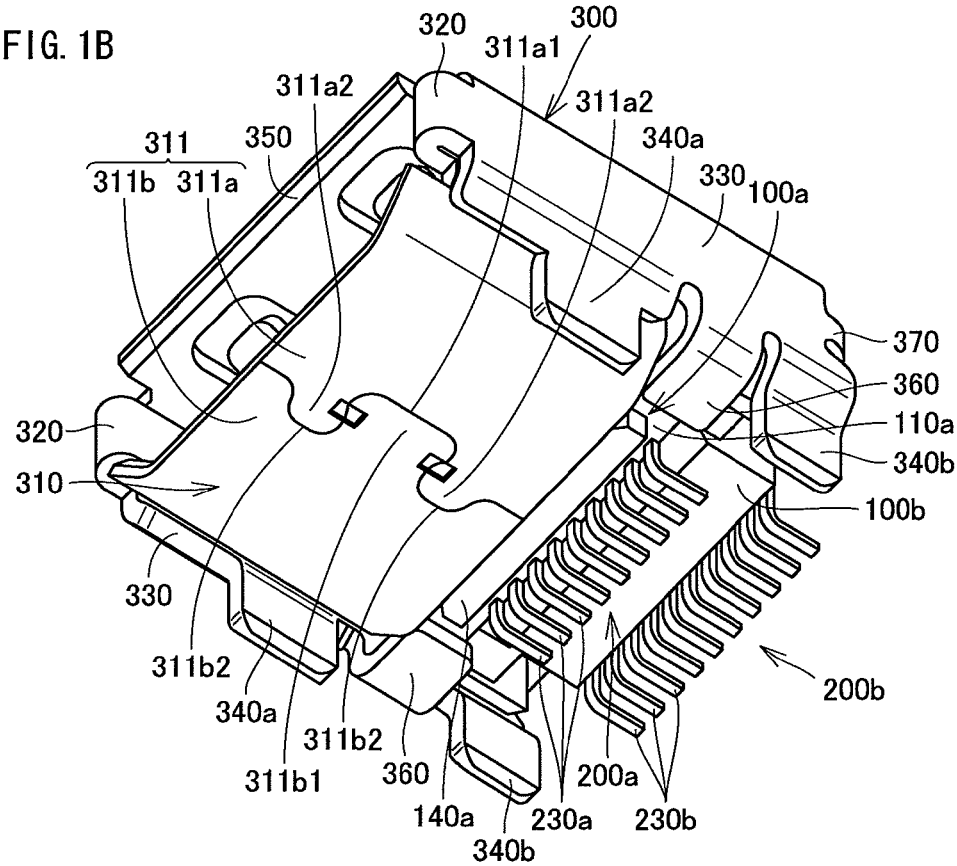

The holders 360 are L-shaped plates arranged between the first locking pieces 340*a* and the second locking pieces 340*b*. As shown in FIGS. 1B, 2B, and 2D, the holders 360 hold portions outside the elongated protrusion 140*a* of the main body 110*a* of the first body 100*a* contained in the body containing space α. As shown in FIG. 3B, a distance between the holders 360 and the linking plate 350 is substantially the same as a height dimension of the main body 110*a* of the first body 100*a*. This allows an upper surface of the main body 110*a* to abut on the linking plate 350 in a state where the main body 110*a* is held by the holders 360. Moreover, a distance between the side walls 330 is substantially the same as a distance between outer surfaces of the walls 130*a* of the first body 100*a*. This allows the outer surfaces of the walls 130*a* to abut on inner surfaces of the side walls 330 in a state where the first body 100*a* is contained in the body containing space α.

Hereinafter, an assembling procedure of the receptacle connector configured as described above will be described. First, the first body 100*a* with the first buried portions 210*a* of the first contacts 200*a* buried therein by insert molding, and the second body 100*b* with the second buried portions 210*b* of the second contacts 200*b* buried therein by insert molding are prepared. The second contact portions 220 of the second contacts 200*b* are aligned and inserted into the holes 111*a* of the first bodies 100*a* as shown in FIGS. 4 and 6A.

Thereafter, the first body 100*a* and the second body 100*b* are brought relatively close to each other, and the fitting projections 120*b* of the second body 100*b* are fitted into the fitting recesses 112*a* of the first body 100*a*. At this time, the second contact portions 220*b* advances inside the holes 111*a* of the first body 100*a* and enters the second long grooves 122*a* of the first body 100*a*. This results in the first and second contact portions 220*a*, 220*b* to be arranged at different height positions in two (upper and lower) rows in a zigzag manner. At the same time, the first and second tail portions 230*a*, 230*b* are arranged at the same height in two front and back lines. The first body 100*a* and the second body 100*b* are thus combined in the fore-and-aft direction γ.

The combined first and second bodies 100*a*, 100*b* are then inserted into the body containing space α of the shield case 300 from behind as shown in FIGS. 5A and 5B, and the front surface of the elongated protrusion 140*a* of the first body 100*a* is brought into abutment with the abutting stop surface 313 of the base 310 of the shield case 300. At the same time, the portions outside the elongated protrusion 140*a* of the main body 110*a* of the first body 100*a* are placed on the holders 360. On the other hand, the upper surface of the main body 110*a* abuts the linking plate 350, and the walls 130*a* abut the inner surfaces of the side walls 330.

Thereafter, the lock pieces 370 are bent so as to abut the respective hills 130*b* of the second body 100*b*. As a result, the first and second bodies 100*a*, 100*b* are sandwiched between the abutting stop surface 313 of the base 310 and the lock pieces 370, and the first and second contact portions 220*a*, 220*b* and the first and second tail portions 230*a*, 230*b* are securely disposed in the above-described arrangement. In this way the receptacle connector is assembled.

The assembled receptacle connector is mounted on the circuit board 10 in the following steps. First, the first and second locking pieces 340*a*, 340*b* of the shield case 300 are inserted into the first and second locking holes 12*a*, 12*b* of the circuit board 10 to set the base 310 of the shield case 300 in a setting region β shown in FIG. 9 of the circuit board 10. When the receptacle connector is set in place, the first and second tail portions 230*a*, 230*b* of the first and second contacts 200*a*, 200*b* are placed on top of the first and second electrodes 11*a*, 11*b*, respectively, of the circuit board 10. The first and second locking pieces 340*a*, 340*b* are then connected by soldering to the first and second locking holes 12*a*, 12*b* of the circuit board 10, and the first and second tail portions 230*a*, 230*b* are also soldered to the first and second electrodes 11*a*, 11*b* of the circuit board 10.

In the above-described receptacle connector, as the first and second contacts 200*a*, 200*b* are embedded by insert molding in the first and second bodies 100*a*, 100*b*, respectively, even if the connector is downsized, the first and second bodies 100*a*, 100*b* can have enough thickness to embed and hold the first and second contacts 200*a*, 200*b*. In addition, the first and second contacts 200*a*, 200*b* are less prone to distortion compared to a case where the contacts are press-fitted into the bodies. The first and second contacts 200*a*, 200*b* are thus advantageous in reducing the pitch variation therebetween due to distortion.

Moreover, when the first and second bodies 100*a*, 100*b* combined in the fore-and-aft direction γ are sandwichingly held between the abutting stop surface 313 of the base 310 and the lock pieces 370, the portions outside the elongated protrusion 140*a* of the main body 110*a* of the first body 100*a* are placed on the holders 360, the upper surface of the main body 110*a* abuts the linking plate 350, and the walls 130*a* abut the inner surfaces of the side walls 330. The first and second bodies 100*a*, 100*b* are thus securely fixed inside the shield case 300, resulting in accurate and secure positioning of the first and second contacts 200*a*, 200*b*. Particularly, the elongated protrusion 140*a* of the first body 100*a*, located near the first tail portions 230*a*, abuts the abutting stop surface 313 of the base 310 and is thereby fixed in position, so that the first and second tail portions 230*a*, 230*b* are fixed with a highly accurate mounting pitch and coplanarity.

As described above, the present receptacle connector has a configuration suitable for reduced size and height. This allows the downsizing of a mating plug P. Moreover, in the circuit board 10 of the above-described electronic equipment mounting the downsized receptacle connector, it is possible to minimize a distance between the receptacle connector and another connector for another interface. Consequently, a unit including the receptacle connector of the electronic equipment can be minimized in size and thickness.

Furthermore, the first and second locking pieces 340*a*, 340*b* of the shield case 300 are provided in the side walls 330 extending along the extended portions 312 of the base 310, so that the base 310 does not have any holes formed by cutting out the locking pieces. That is, the base 310 has no holes or the like, except a very narrow gap that may be left at a portion where the first and second pieces 311*a*, 311*b* are caulked and joined. When the base 310 is set in the setting region β of the circuit board 10 and the first and second locking pieces 340*a*, 340*b* are soldered to the circuit board 10, the shield case 300 configured as above is advantageous in preventing the entry of solder and flux into the body containing space α of the shield case 300. In addition, the side walls 330 linked by the linking plate 350 are resistant to inclination and/or skew, even when the plug P is twisted inside the body containing space α (if the plug P is rotated in the circumferential direction). Thus, the shield case is advantageous in reducing load applied on the folded-back portions 320 and on the soldered portions between the first and second locking pieces 340*a*, 340*b* and the circuit board 10 due to the inclination and/or skew of the side walls 330.

The above-described receptacle connector is not limited to the above-described embodiment, but may be modified in design within the scope of claims. Hereinafter, modifications are described more in detail.

Figure 10A:
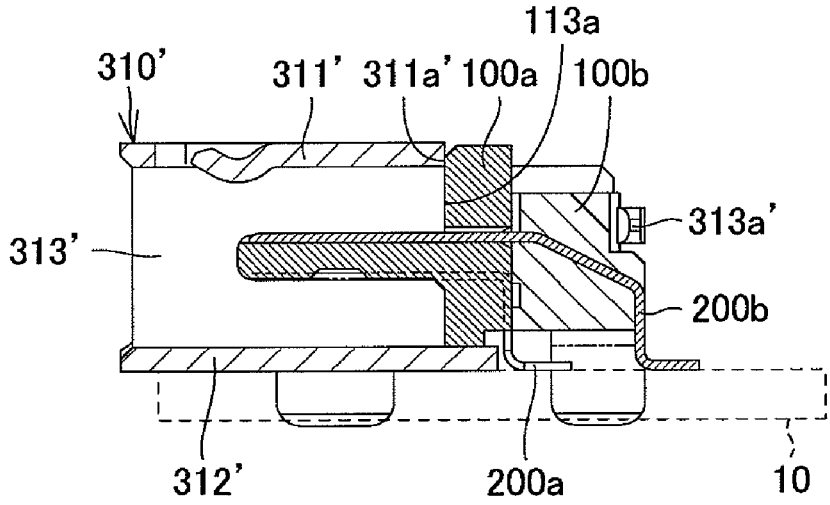
FIGS. 10A and 10B are schematic sectional views showing modified designs of the shield case of the connector.
Figure 10B:
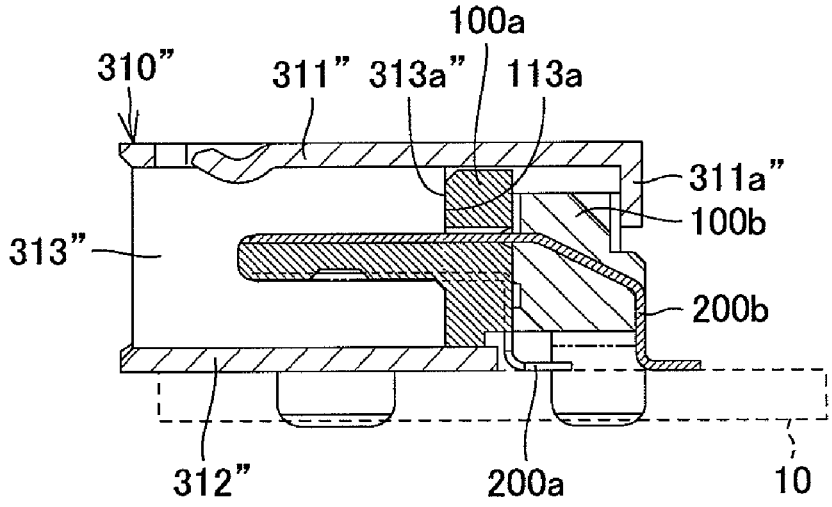

First, the shield case 300 of the invention is not limited to one according to the above-described embodiment having the base 310, the folded-back portions 320, the side walls 330, the first and second locking pieces 340*a*, 340*b*, the linking plate 350, the holders 360, and the lock pieces 370. Any modification in design can be made to the shield case as long as it has at least a tuboid body containing portion adapted to contain the first and second bodies, and as long as at least one plate of the top plate, the bottom plate and the side plates of the body containing portion is smaller in length than the other plates, and a back surface of the one plate functions as an abutting stop surface on which the first body abuts, and a back surface of at least one of the other plates is provided with a lock piece, and the first and second bodies are sandwiched between the abutting stop surface and the lock piece. FIG. 10A exemplifies a modified shield case having a body containing portion 310'. A top plate 311' of the body containing portion 310' is smaller in length than a bottom plate 312' and side plates 313', and a back surface of the top plate 311' serves as an abutting surface 311*a*', on which the first body 100*a* abuts. The first and second bodies 100*a*, 100*b* may be sandwiched between the abutting surface 311*a*' and lock pieces 313*a*' provided on the side plates 313'. An alternative modification is shown in FIG. 10B. A shield case 300" also has a body containing portion 310' of a substantially O shape in front view, but side plates 313" of the body containing portion 310" are smaller in length than a top plate 311" and a bottom plate 312". Back surfaces of the side plates 313" serve as abutting surfaces 313*a*", on which the first body 100*a* abuts. The first and second bodies 100*a*, 100*b* may be sandwiched between the abutting surfaces 313*a*" and lock pieces 311*a*" provided in the top plate 311". In this modification, a distance between the top plate 311" and the bottom plate 312" is substantially the same as the height dimension of the first body 100*a*, so that the upper surface of the first body 100*a* abuts the top plate 311", and the lower surface thereof abuts the bottom plate 312". Further alternatively, if the lock pieces are provided on the bottom plate of the body containing portion, widthwise opposite end portions of the bottom plate may be extended to have the same length as that of the side plates, and back end surfaces of the end portions may be provided with the lock pieces. At least one lock piece should be provided on one of the bottom plate, the top plate and the side plates of the body containing portion, but more than one lock pieces may be provided on two of the plates or on all of them.

Figure 11:
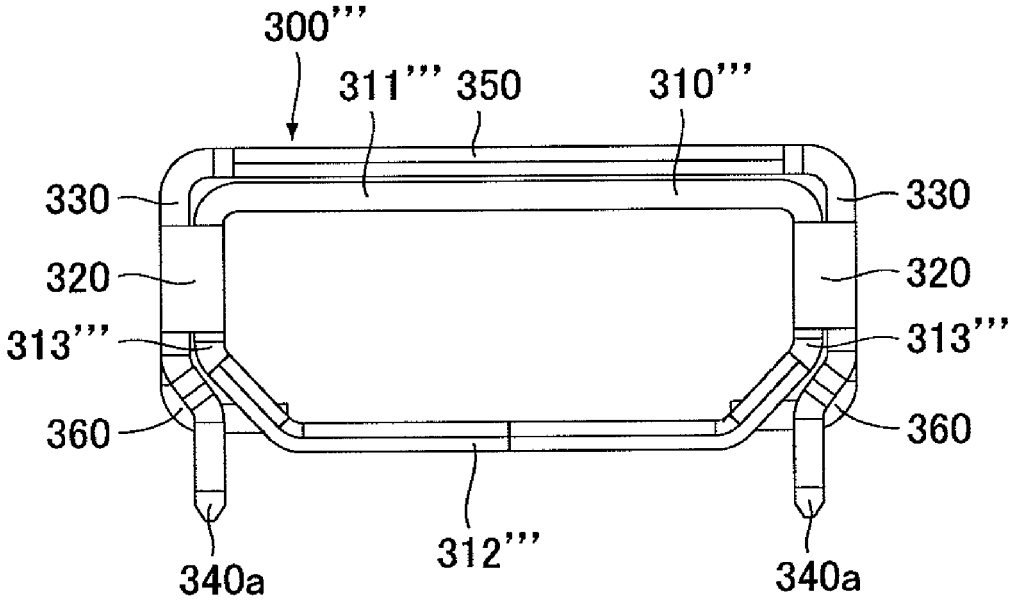
FIG. 11 is a schematic front view showing another modified design of the shield case of the connector, having a body containing portion of a substantially O shape in front view in place of the base.

Still alternatively, the shield case of the invention can be modified as a shield case 300''', as shown in FIG. 11, Particularly, a body containing portion 310''' of the shield case 300''' has a substantially O shape in front view (square tuboid shape) in place of the base 310. The body containing portion 310''' may have a top plate 311''', a bottom plate 312''', and a pair of side plates 313'''. The top plates 311''' and the bottom plates 312''' are opposed to each other. The side plates 313''' is a plate body connecting both end portions in a width direction of the top plate 311''' and both end portions in the width direction of the bottom plate 312'''. The folded-back-portions 320 are provided in front surfaces of the side plates 313''', respectively, and the side walls 330 extend along the side plates 313'''. The other configurations of the shield case 300''' are substantially the same as those of the shield case 300. The body containing portion 310''' may be provided with the first and second locking pieces 340*a*, 340*b*. In this case, the folded-back portions 320 and the side walls 330 can be omitted.

Figure 12:
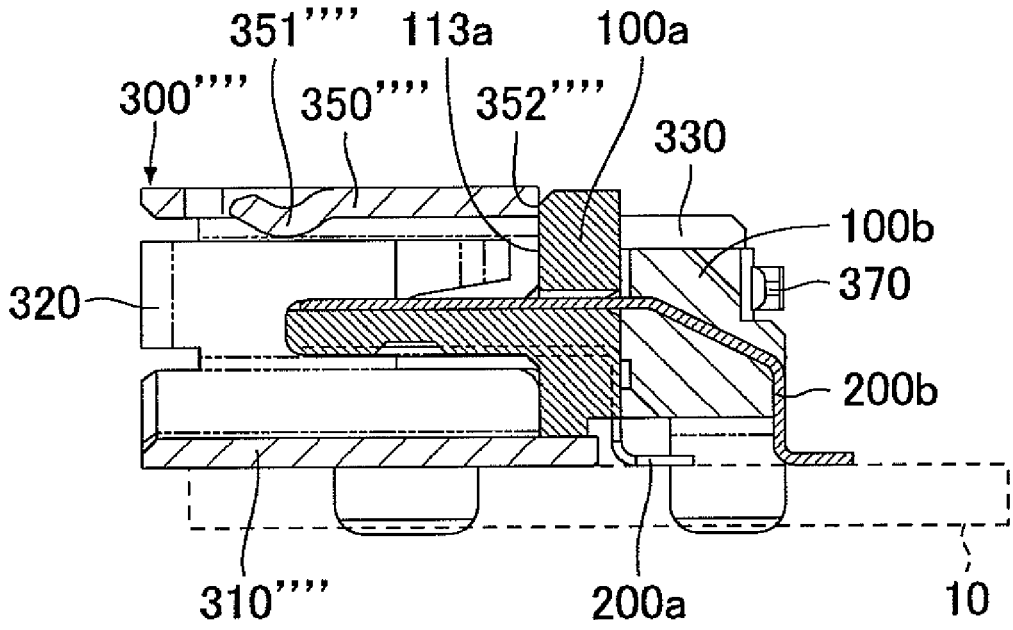
FIG. 12 is a schematic cross-sectional view showing a modified connector.

The first and second locking pieces 340*a*, 340*b* may be omitted if the connector is a plug connector that is not mounted on the circuit board 10. If the connector is a plug connector, the first and second tail portions of the first and second contacts may be connected to lead wires of a cable. Alternatively, the first and second tail portions of the plug connector may be connected to ends of conductive lines formed on a circuit board, and the other ends of the conductive lines may be connected to lead wires of a cable. If the connector is a receptacle connector, provision of at least the first locking pieces 340*a* should suffice. Obviously, the shield case may have three or more pairs of locking pieces. Moreover, the first locking pieces 340*a* may be or may not be positioned forward of the front surface 113*a* of the first body 100*a*. Moreover, the first and second locking pieces 340*a*, 340*b* only need to extend downward from lower ends of the side walls 330, and they may be extended obliquely downward from the lower ends of the side walls 330. Moreover, the holders 360 may be omitted. If the holders 360 are omitted, a portion of the first body 100*a* may be placed on a base 310"" as shown in FIG. 12. Alternatively, the first body 100*a* may be placed on both the holders and the base.

Moreover, the linking plate 350 in the above-described embodiment is a plate that links the upper ends of the side walls 330, but it may be in any form that can link the side walls 330. For instance, the linking plate 350 may be provided separately from the side walls 330 to bridge between and link the side walls 330. Moreover, the length dimensions of the linking plate 350 and the side walls 330 may be and may not be larger than the length dimension of the base 310. For instance, FIG. 12 illustrates a shield case 300"" having a linking plate 350"" of a smaller length dimension than that of a base 310"". In this case, a back surface of the linking plate 350"" may function as an abutting stop surface 352"", on which the front surface 113*a* of the first body 100*a* may abut. That is, the first and second bodies 100*a* and 100*b* may be sandwiched between the abutting stop surface 352"" and lock pieces 370. In this case, the elongated protrusion 140*a* can be omitted.

The lock pieces may provided on the back plate of the base 310 or on the linking plate 350. In the former case, the opposite widthwise end portions of the bottom plate of the base may be extended to have a substantially same length as those of the side walls, and the end portions may be provided with the lock pieces. Moreover, the lock pieces may or may not abut on the hills of the second body. The lock pieces may abut any portions of the second body as long as they can sandwich the first and second bodies between the abutting stop surface and themselves.

The base 310 in the above-described embodiment is configured to have the base body 311 and the extended portions 312, but may be in any form with a generally U-shape in front view. Moreover, the present invention is not limited to a case of the above-described embodiment where the first piece 311*a* has the first recess 311*a*1 and the pair of first protrusions 311*a*2, and where the second piece 311*b* has the second protrusion 311*b*1 and the second recesses 311*b*2. The first piece 311*a* should have at least the first recess 311*a*1, and the second piece 311*b* should have at least the second protrusion 311*b*1. Moreover, instead of dividing the base 310 into two pieces, the linking plate 350 may be divided in the width direction into two (first and second) pieces, so that a protrusion of the second piece may be fitted into a recess of the first piece.

The connector of the invention may have three or more bodies combined in the fore-and-aft direction γ. The fitting projections 120*b* may be provided on the back surface (surface facing the second body) of the first body 100*a*, and the fitting recesses 112*a* may be provided in the front surface (surface facing the first body) of the second body 100*b*. It is also possible to omit the fitting projections 120*b* and the fitting recesses 112*a*. While the elongated protrusion 140*a* of the above embodiment is provided on the lower surface of the main body 110*a*, the invention is not limited thereto but may have any protruded portion that can abut on the abutting stop surface 313 and is located near the first tail portions.

Figure 13A:
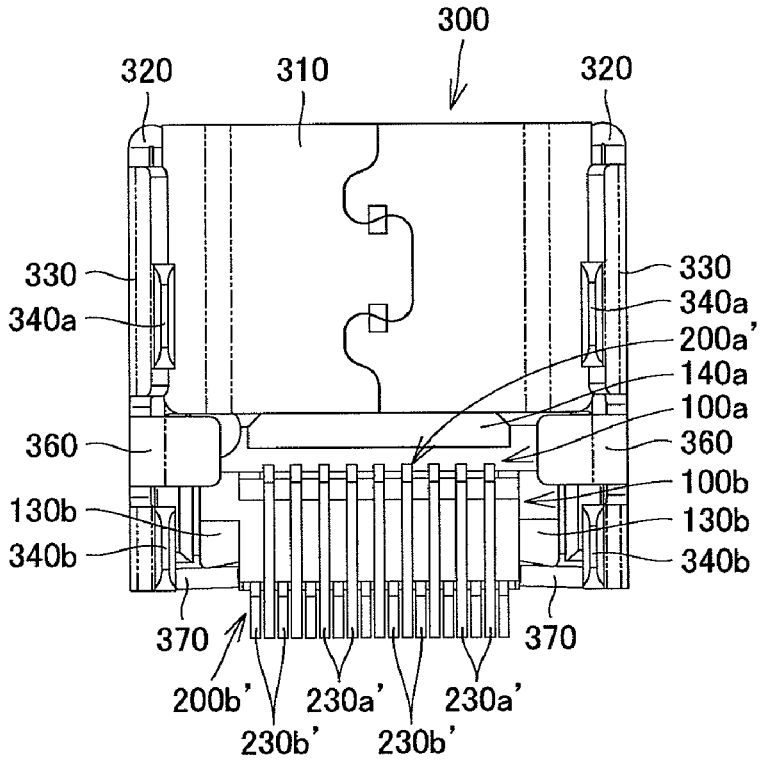
FIGS. 13A and 13B are schematic views showing design modifications of the first and second tail portions of the first and second contacts of the connector.
Figure 13B:
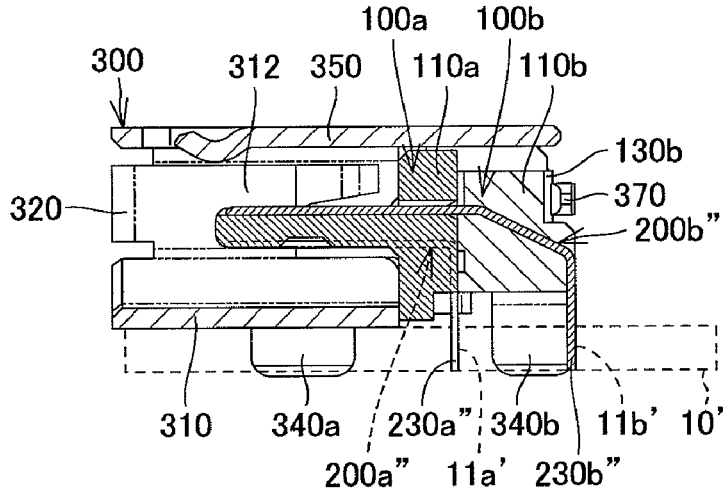

The connector of the invention may have three or more types of contacts arranged in three or more rows and embedded in respective bodies. The present invention is not limited to a case of the above-described embodiment where the first and second tail portions 230*a*, 230*b* are arranged in two rows in the fore-and-aft direction, with the first and second bodies 100*a*, 100*b* combined. FIG. 13A illustrates a modified connector wherein first tail portions 230*a*' are made longer to align back ends of the first and second tail portions 230*a*' and 230*b*' along the width of the connector in a row. FIG. 13B illustrates another modified connector wherein first and second tail portions 230*a*", 230*b*" extend downward into first and second through-holes 11*a*', 11*b*' of a circuit board 10' and are connected thereto by dip soldering process. It is also possible to arrange the first and second tail portions 230*a*", 230*b*" in a row so as to be soldered into first and second through-hole electrodes 11*a*', 11*b*' that are also arranged in a row. Furthermore, the invention may be configured such that a portion of each of the first and second contact portions is bent in a direction close to each other. For example, distal end portions of the first contact portions 220*a* may be bent upward, and distal end portions of the second contact portions 220*b* may be bent downward.

The materials, shapes, numbers, dimensions etc. of the respective elements of the receptacle connector in the above-described embodiments have been described by way of example only, the receptacle connector of the invention may be modified in design in any manner as long as similar functions can be realized. While the present invention is described in the above-described embodiment as an HDMI receptacle connector, the present invention is not limited thereto but can be applied to any board-mounting type connectors. Moreover, while the television receiver is mentioned above as exemplifying the electronic equipment, the present invention is not limited thereto.

Reference Signs List

10 Circuit board
11*a* First electrode
11*b* Second electrode
12*a* First locking hole
12*b* Second locking hole
100*a* First body
110*a* Main body
  111*a* Hole
  112*a* Fitting recess
  113*a* Front surface (abutting surface)
120*a* Projected portion
  121*a* First long groove
  122*a* Second long groove
130*a* Wall
140*a* Elongated protrusion
100*b* Second body
110*b* Main body
120*b* Fitting protrusion
130*b* Hill
200*a* First contact
210*a* First buried portion
220*a* First contact portion
230*a* First tail portion
200*b* Second contact
210*b* Second buried portion
220*b* Second contact portion
230*b* Second tail portion
300 Shield case
310 Base
  311*a* First piece
    311*a*1 First recess
    311*a*2 First protrusion
  311*b* Second piece
    311*b*1 Second protrusion
    311*b*2 Second recess
  312 Extended portion (widthwise end portions of the base)
  313 Abutting stop surface
320 Folded-back portion
330 Side wall
340*a* First locking piece
340*b* Second locking piece
350 Linking plate (linking portion)
360 Holder
370 Lock piece
α Body containing space (body containing portion)

The invention claimed is:

1. A connector comprising:

a shield case having a body containing portion;

first and second bodies, contained in the body containing portion of the shield case and combined in a fore-and-aft direction;

a plurality of first contacts, embedded in the first body and arranged in a row in a width direction of the first body; and a plurality of second contacts, embedded in the second body and arranged in a width direction of the second body in a different row from the row of the first contacts, wherein the body containing portion includes a top plate, a bottom plate and a pair of side plates, at least one plate of the top plate, the bottom plate and the side plates is smaller in length than the other plates, and a back surface of the one plate functions as an abutting stop surface on which the first body abuts, and a back surface of at least one of the other plates is provided with a lock piece, and the first and second bodies are sandwiched between the abutting stop surface and the lock piece.

2. The connector according to claim 1, wherein the first body has a fitting protrusion on a surface thereof facing the second body and the second body has a fitting recess in a surface thereof facing the first body, or alternatively the first body has a fitting recess in a surface thereof facing the second body and the second body has a fitting protrusion on a surface thereof facing the first body, and the fitting protrusion fits into the fitting recess when the first and second bodies are combined.

3. The connector according to claim 1, wherein a distance between the bottom plate and the top plate is substantially the same as a height dimension of the first body, and a lower surface of the first body abuts the bottom plate, and an upper surface of the first body abuts the top plate.

4. The connector according to claim 1, which is a receptacle connector, wherein the back surface of the bottom plate serves as the abutting stop surface, the first body includes:

a main body of a generally rectangular shape in cross-sectional view;

a projected portion, projected from a front surface of the main body; and a protruded portion, provided on a lower surface of the main body and abutting the abutting stop surface, the projected portion has first and second surfaces in a thickness direction thereof, the first and second surfaces being provided with first long grooves and second long grooves, respectively, extending in the fore-and-aft direction, the main body has holes communicating with the second long grooves, each of the second contacts includes:

a second buried portion embedded in the second body;

a second contact portion continued from a lengthwise end of the second buried portion and received in one of the holes and one of the second long grooves; and a second tail portion continued from the other lengthwise end of the second buried portion, and each of the first contacts includes:

a first buried portion embedded in the main body of the first body;

a first contact portion continued from a lengthwise end of the first buried portion and received in one of the first long grooves of the projected portion; and a first tail portion continued from the other lengthwise end of the first buried portion and disposed near the protruded portion.

5. The connector according to claim 1, which is a receptacle connector, wherein the shield case includes:

the body containing portion of a generally O-shape in front-plane view;

a pair of folded-back portions, extending from front surfaces of the side plates of the body containing portion and folded back backward, or alternatively extending from the back surfaces of the side plates of the body containing portion and folded back forward;

a pair of side walls, extending from the folded-back portions along the side plates of the body containing portion;

a pair of first locking pieces, extending downward from the side walls; and a linking portion adapted to link between the side walls.

6. The connector according to claim 1, which is a receptacle connector, the shield case comprising:

a base of a generally U-shape in front view having widthwise end portions, the end portions each having a front surface and a back surface;

a pair of folded-back portions, provided on the front surfaces of the end portions of the base and folded back backward, or alternatively provided on the back surfaces of the end portions of the base and folded back forward;

a pair of side walls, extending from the folded-back portions along the end portions of the base;

a pair of first locking pieces, extending downward from the side walls; and a linking portion adapted to link between the side walls, wherein the body containing portion is defined by the base, the side walls and the linking portion, the base serves as the bottom plate, the side walls serve as the side plates, and the linking portion serves as the top plate, the base is smaller in length than the linking portion, and a back surface of the base serves as the abutting stop surface, and the back surfaces of the side walls or the back surface of the linking portion of the shield case is provided with a lock piece, and the first and second bodies are sandwiched between the abutting stop surface and the lock piece.

7. The connector according to claim 1, which is a receptacle connector, the shield case comprising:

a base of a generally U-shape in front view having widthwise end portions, the end portions each having a front surface and a back surface;

a pair of folded-back portions, provided on the front surface of the end portions of the base and folded back backward, or alternatively provided on the back surfaces of the end portions of the base and folded back forward;

a pair of side walls, extending from the folded-back portions along the end portions of the base;

a pair of first locking pieces, extending downward from the side walls; and a linking portion adapted to link between the side walls, wherein the body containing portion is defined by the base, the side walls and the linking portion, the base serves as the bottom plate, the side walls serve as the side plates, and the linking portion serves as the top plate, the linking portion is smaller in length than the base, and a back surface of the linking portion serves as the abutting stop surface, and the back surfaces of the side walls or the back surface of the base of the shield case is provided with a lock piece, and the first and second bodies are sandwiched between the abutting stop surface and the lock piece.

8. The connector according to claim 5, wherein the first locking pieces are provided on lower ends of the side walls, and the linking portion links between upper ends of the side walls.

9. The connector according to claim 6, wherein the first locking pieces are provided on lower ends of the side walls, and the linking portion links between upper ends of the side walls.

10. The connector according to claim 7, wherein the first locking pieces are provided on lower ends of the side walls, and the linking portion links between upper ends of the side walls.

11. The connector according to claim 8, wherein the first body has an abutting surface, on which a distal end surface of a plug inserted in the body containing portion is abuttable, and the first locking pieces are disposed forward of the abutting surface.

12. The connector according to claim 9, wherein the first body has an abutting surface, on which a distal end surface of a plug inserted in the body containing portion is abuttable, and the first locking pieces are disposed forward of the abutting surface.

13. The connector according to claim 10, wherein the first body has an abutting surface, on which a distal end surface of a plug inserted in the body containing portion is abuttable, and the first locking pieces are disposed forward of the abutting surface.

14. The connector according to claim 5, further comprising a pair of second locking pieces extending downward from the lower ends of the side walls.

15. The connector according to claim 6, further comprising a pair of second locking pieces extending downward from the lower ends of the side walls.

16. The connector according to claim 7, further comprising a pair of second locking pieces extending downward from the lower ends of the side walls.

17. The connector according to claim 6, wherein the side walls and the linking portion are larger in length than the base, the side walls have non-facing regions at lower ends thereof, the non-facing regions not facing the base, the shield case further comprises a pair of holders provided in the respective non-facing regions, a distance between the holders and the linking portion is substantially the same as a height dimension of the first body, and a lower surface of the first body abuts the holders, and an upper surface of the first body abuts the linking portion.

18. The connector according to claim 6, wherein the base or the linking portion has a first piece provided with a recess and a second piece provided with a protrusion, and the first and second pieces are caulked in a state where the protrusion is fitted into the recess.

19. The connector according to claim 7, wherein the base or the linking portion has a first piece provided with a recess and a second piece provided with a protrusion, and the first and second pieces are caulked in a state where the protrusion is fitted into the recess.

20. The connector according to claim 4, which is a receptacle connector, wherein the first and second tail portions are arranged in two rows in the fore-and-aft direction.

21. The connector according to claim 4, which is a receptacle connector, wherein the first and second contacts are arranged in a zigzag manner, and the first and second tail portions are aligned in a row.

22. The receptacle connector according to claim 20, which is a receptacle connector, wherein the first and second tail portions are hung downward.

23. The receptacle connector according to claim 21, which is a receptacle connector, wherein the first and second tail portions are hung downward.

24. An electronic instrument comprising the connector according to claim 4 serving as an external interface thereof.

25. An electronic instrument comprising the connector according to claim 5 serving as an external interface thereof.

26. An electronic instrument comprising the connector according to claim 6 serving as an external interface thereof.

27. An electronic instrument comprising the connector according to claim 7 serving as an external interface thereof.

* * * * *